United States Patent [19]

Henderson

[11] Patent Number: 4,742,925

[45] Date of Patent: May 10, 1988

[54] PAIL STORAGE SHELF AND RACK

[76] Inventor: Joseph E. Henderson, 5422 Spahn Ave., Lakewood, Calif. 90713

[21] Appl. No.: 40,374

[22] Filed: Apr. 17, 1987

[51] Int. Cl.[4] ..... A47F 7/00

[52] U.S. Cl. ..... 211/71; 108/111; 211/135; 211/187

[58] Field of Search ..... 211/187, 71, 135, 186, 211/153, 191, 74, 59.2; 108/111

[56] References Cited

U.S. PATENT DOCUMENTS

| | | | |
|---|---|---|---|
| 1,100,306 | 6/1914 | Hunt | 211/135 X |
| 1,745,164 | 1/1930 | Griffith | 211/135 X |
| 2,218,444 | 10/1940 | Vineyard | 211/59.2 |
| 2,228,775 | 1/1941 | Morgan | 211/59.2 X |
| 3,628,672 | 12/1971 | Heinz | 211/153 |
| 3,765,344 | 10/1973 | Ferdinand et al. | 211/135 X |
| 3,870,157 | 3/1975 | Hayward | 211/153 X |
| 4,048,059 | 9/1977 | Evans | 211/187 X |
| 4,078,664 | 3/1978 | McConnell | 211/187 X |
| 4,101,233 | 7/1978 | McConnell | 211/187 X |

FOREIGN PATENT DOCUMENTS

| | | | |
|---|---|---|---|
| 189911 | 12/1922 | United Kingdom | 211/135 |

*Primary Examiner*—Robert W. Gibson, Jr.

*Attorney, Agent, or Firm*—Plante, Strauss & Vanderburgh

[57] ABSTRACT

There is disclosed a storage shelf which is specifically designed for an orderly storage of pails with tapered sidewalls. The shelf is used on a rack with end frames which support longitudinal rails at each shelf level. The shelves of the invention are supported between the longitudinal rails, with their ends resting on ledges which are on the inside surface of each rail. Each shelf is formed of heavy gauge sheet metal having coextensive, sidewalls with inclined inside walls. The height and inclination of the inside walls corresponds to the difference between the top and bottom diameters of the pails. This results in a shelf having inclined sidewalls which center the pails on the shelves, yet which provides minimal clearance between the tops of the pails, from row to row, thereby achieving automatic alignment of the pails without increasing the overall size or bulk of the storage unit. Each shelf is braced by its sidewalls and by a central longitudinal rib on its undersurface. To adapt the shelf to fit conventional racks, an angle is placed transversely on each end, thus locating the shelf beneath the top edge of the rail at a distance equal to the height of the sidewalls of the shelf. Also, in a preferred embodiment, a cross wall is provided medially of the shelf.

10 Claims, 3 Drawing Sheets

PAIL STORAGE SHELF AND RACK

BACKGROUND OF THE INVENTION

1. Field of Invention

This invention relates to a shelf for use in a storage rack and, in particular, to a shelf storage system for pails having tapered sidewalls.

2. Brief Statement of the Prior Art

Liquid materials such a inks, paints and the like are commonly contained in five gallon pails having tapered sidewalls, with bottoms of lesser diameters than the tops. In printing establishments, these pails are used for the many grades and colors of printing inks. Storage shelves and racks have been provided for these pails, however, heretofore there has been no storage system specifically designed for these pails. Instead, the pails are commonly placed on shelves of storage racks which do not provide any orderly arrangement of the pails, usually resulting in a very random or haphazard alignment of the pails on the storage racks.

The typical storage rack which is used has upright ends with longitudinal side bars located at each shelf level. These side bars have shelf supports to support the ends of the shelves which are laid transversely across the assembly with their ends resting on the longitudinal rails. As the shelves which have been used heretofore have entirely flat top surfaces, there has been no guidance for alignment of the pails into orderly rows or other arrangements.

BRIEF DESCRIPTION OF THE INVENTION

This invention comprises a storage shelf for use with a rack which is specifically designed for an orderly storage of pails with tapered sidewalls. The shelf is used on an otherwise conventional rack which has upright end frames that support longitudinal rails at each shelf level. A shelf support ledge extends coextensively along the inside surface of each rail and the shelves of the invention are supported between these rails, with their ends resting on the ledges. Each shelf of the invention is formed of heavy gauge sheet metal having coextensive, sidewalls with inclined inside walls. The height and inclination of these inside walls corresponds to the difference between the top and bottom diameters of the pails. This results in a shelf having inclined sidewalls which center the pails on the shelves, yet which provide minimal clearance between the tops of the pails, from row to row, thereby achieving automatic alignment of the pails without increasing the overall size or bulk of the storage unit. Each shelf can be braced with a centrally located longitudinal reinforcement member, rib on its undersurface. To adapt the shelf to fit conventional racks, an angle is placed transversely on each end, thus locating the shelf beneath the top edge of the rail at a distance equal to the height of the sidewalls of the shelf. Also, in a preferred embodiment, a cross wall is provided medially of the shelf.

BRIEF DESCRIPTION OF THE DRAWINGS

The invention will be described with reference to the FIGURES of which.

DESCRIPTION OF PREFERRED EMBODIMENT

Figure 1:
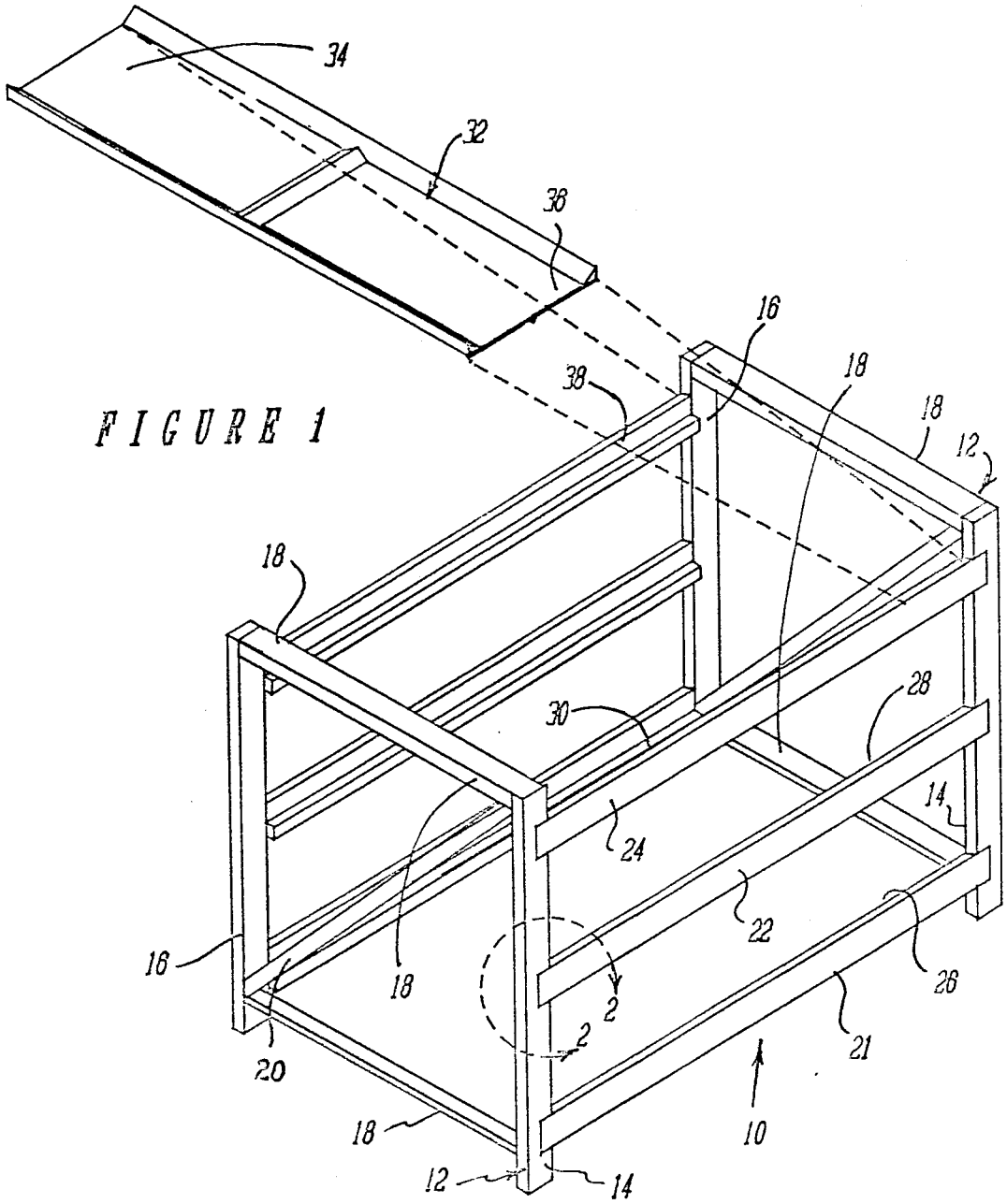
FIG. 1 is a perspective view of the storage system of the invention.

This invention comprises a shelf, and a storage system using the shelf, for pails with tapered sidewalls. The storage system is illustrated in FIG. 1 and generally comprises a generally conventional storage rack 10 having end frames 12 formed of upright legs 14 and 16 and transverse braces 18. The end frames 12 can have one or more diagonal braces 20 to provide rigidity to the assembly. Commonly, these end frames 12 are formed of round or square tubular steel members and the braces can be steel angles, channels or round or square tubular members. Each rack has a plurality of longitudinal rails 21, 22 and 24 which are located at each shelf level. In the illustrated embodiment, three shelf levels 26, 28 and 30 are provided, requiring six of the longitudinal rails.

The longitudinal rails are commonly formed of square or rectangular tubular members, although, channels or angles could also be used. The entire rack is usually assembled by bolting or otherwise fastening the ends of the longitudinal rails to their supporting end walls. Commonly, the end walls are prefabricated and are welded together for permanent assembly.

Figure 2:
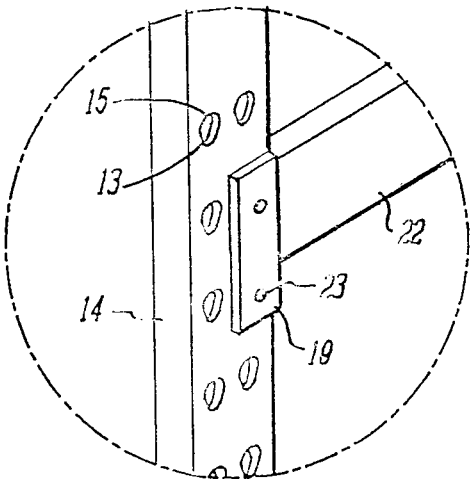
FIG. 2 is an enlarged view of the area 2 of FIG. 1.

FIG. 2, which is an enlarged view of the area within circle 2 of FIG. 1 illustrates the rail assembly in the rack. This rack is conventional in construction and has two rows of apertures which extend along each leg 14. Each aperture has a large diameter top portion 15 and a smaller diameter portion 13 to provide slots which accept pins 23 which are carried on rail brackets 19. The rail brackets are secured to the ends of each rail, such as 22 and permit positioning the rails at any desired level on legs 14 and 16. The pins 23 have sufficiently large heads (not shown) to be received within the larger top portions 15 and retained by the smaller portions 13 of each aperture.

Referring again to FIG. 1, a plurality of shelves 32 are provided at each shelf level, completely covering each level. The shelf 32 is shown in enlarged view in FIG. 1, and the phantom lines indicate its placement on the rack. Each shelf 32 extends transversely across the rack with its opposite ends 34 and 36 supported by shelf supports carried on the inside wall 38 of the rails.

Figure 3:
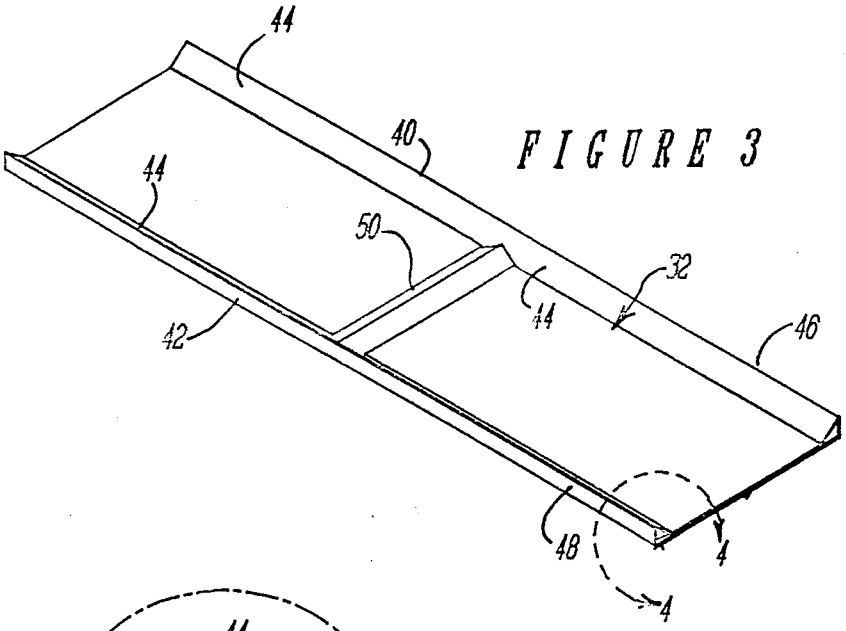
FIG. 3 is a perspective view of the upper surface of a shelf used in the storage system of the invention.

Referring now to FIG. 3, each shelf 32 is formed of heavy gauge sheet metal which is provided with coextensive sidewalls 40 and 42 along each of its longitudinal edges. The inside wall 44 of each sidewall is inclined upwardly, preferably at an angle of from 30° to about 60°. To provide maximum strength to the shelf, the upwardly inclined inside sidewall 44 is provided with a reverse bend 46 along its upper edge, thereby providing the outside vertical wall 48. In its preferred embodiment, each shelf 32 also has, on its upper surface, a transverse or cross wall 50 that is formed of an inverted angle. This embodiment is particularly preferred when the rack 10 is to be accessible from both ends of the shelves as it provides a centering positioning for the innermost pails carried on each shelf.

Figure 4:
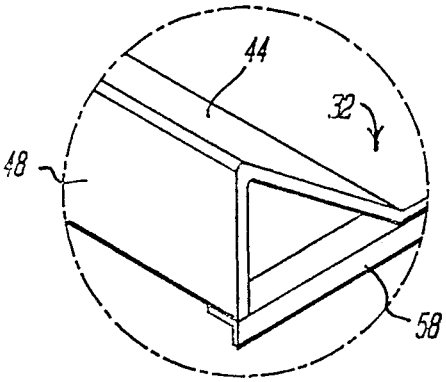
FIG. 4 is a view of the area 4 of FIG. 3.

Referring to FIG. 4, an enlarged view of the area within circle 4 of FIG. 3 is shown. At each end, the shelf has transverse angle members, such as 58 having a vertical wall of approximately ½ inch. As described hereinafter, these angle members provide the appropriate spacing to locate the shelf at the precise height desired relative to the supporting rail members.

Figure 5:
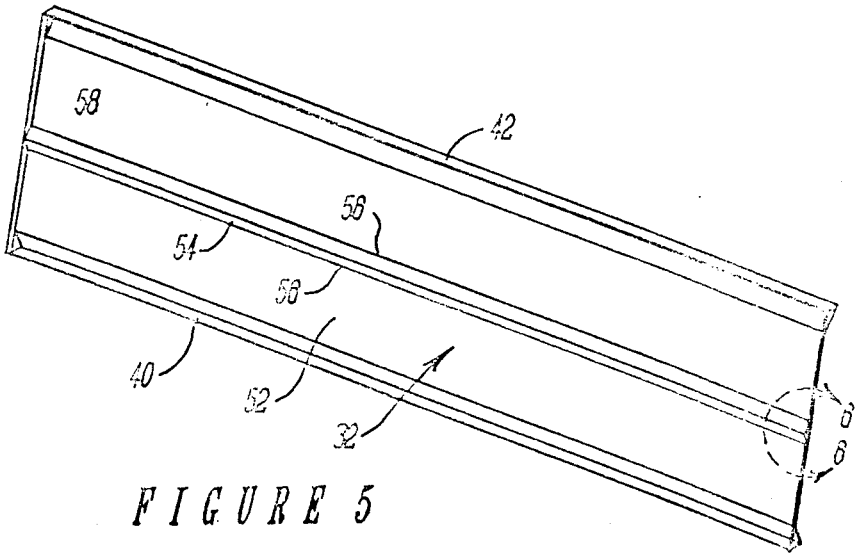
FIG. 5 is a perspective view of the undersurface of the shelf of FIG. 3.

The undersurface 52 of the shelf 32 is shown in FIG. 5. A central reinforcement member, or rib 54 is secured to the undersurface 52 of the shelf 32, coextensive with its length. This reinforcement rib 54 is preferably an inverted angle having its upper edges 56 welded, either continuously or at spot locations, to the undersurface 52 of the shelf 32, thereby providing rigidity to the shelf. Each shelf 32 thus has the integrally formed sidewalls 40 and 42 and the central reinforcing rib 54 to provide rigidity and load carrying capacity.

Figure 6:
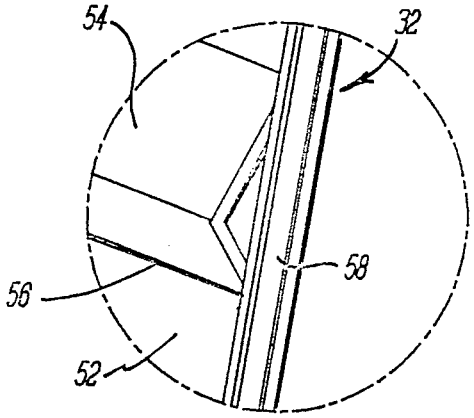
FIG. 6 is a view of the area 6 of FIG. 5.

FIG. 6, which is an enlarged view of the area within circle 6 of FIG. 5 illustrates the end of the reinforcement rib 54. The end of this rib abuts against the inside edge of angle 58 that extends across each end of the shelf 32.

Figure 7:
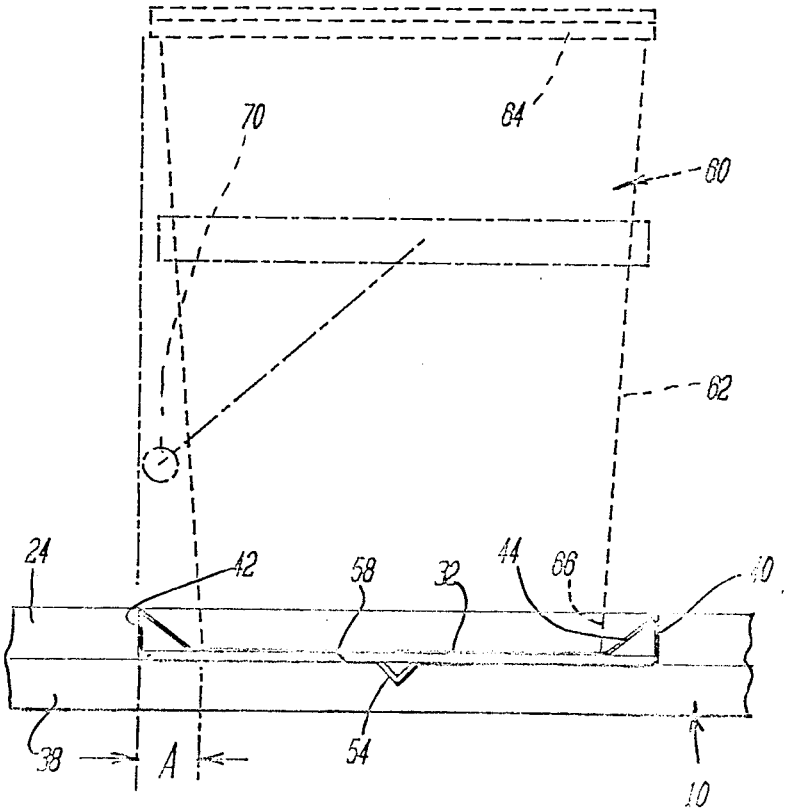
FIG. 7 is an end view of a shelf of the invention illustrating the placement of a pail on the shelf.

Referring now to FIG. 7, the self-alignment feature of the shelves will be described. The shelf 32 is shown in its position on the rack 10, with its ends resting on longitudinal rail 24 and with angle 58 resting on the inside ledge 38 of the rails such as 24, thereby elevating the shelf sufficiently that the top edges of its sidewalls 40 and 42 are flush with the top edges of the rails. As previously mentioned, the shelves are specifically designed for storage of pails 60 having tapered sidewalls 62. Such a pail is illustrated in the phantom lines of the FIGURE with a covered top 64 and a base 66 of lesser diameter than the top, thereby providing a downwardly and inwardly tapered sidewall 62. The flat width of the shelf is approximately equal to the bottom diameter of the pail, and preferably is about 0.5 to 1.0 inch greater than the bottom diameter of the pails. The inclined inside walls 44 of the shelf 32 thus center the pails 60 which are placed on the shelves into an orderly alignment. The distance A at which the bottom edges of the inclined inside sidewalls 44 are located from their outer top edges is approximately equal to the difference in the radii of the tops 64 and bases 66 of the tapered pails 60, thereby ensuring that the edges of the shelves do not project laterally any substantial distance beyond the edges of the tops 64 of the pails. Typically, the pails 60 are located in rows with a slight clearance, e.g., ½ to 1 inch between their top edges, row-to-row, while the shelves can be provided with abutting adjacent edges. The handles 70 of the pails 60 can be received in the resulting space between the pails in adjacent rows.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims.

What is claimed is:

1. In a storage system which includes a rack having a frame of opposite end walls, longitudinal side rails extending therebetween, and shelf supports on inside walls of said side rails, the improved shelving in combination with a plurality of pails having tapered sidewalls, each with a top diameter and a lesser bottom diameter stored thereon, which comprises: a plurality of storage shelves mounted edge to edge with their opposite ends supported by and extending between said shelf supports and each shelf of said plurality of shelves having elevated side walls along each of its side edges coextensive its length with inclined inside edges and having a flat shelf therebetween with a width approximately equal to said bottom diameter of said pails and a total width substantially equal to said top diameter of said pails, whereby the inclined inside walls of said shelves centers said pails which are placed thereon, in an orderly alignment.

2. The storage system of claim 1 wherein said shelf has a laterally extending angle on the undersurface of each of its ends with a sufficient height to raise said shelf and align the top edges of its sides with the top edge of said longitudinal side rails of said rack.

3. The storage system of claim 1 wherein said shelf has a central longitudinal brace on its undersurface.

4. The storage system of claim 1 wherein said shelf has a central lateral wall on its upper surface.

5. The storage system of claim 1 wherein said overall width of said shelf is from ½ to 1 inch greater then said top diameter of said pails.

6. The storage system of claim 1 wherein said rack has a plurality of said side rails, with two side rails each disposed at each of a plurality of shelf levels, and with a plurality of said shelves supported by and extending between said ledges at each shelf level.

7. The storage system of claim 6 wherein said each of said shelves has a laterally extending angle on the undersurface of each of its ends with a sufficient height to raise said shelf and align the top edge of its sides with the top edge of said longitudinal side rails.

8. The storage system of claim 6 wherein each of said shelves has a central longitudinal brace on its undersurface.

9. The storage system of claim 6 wherein each of said shelves has a central lateral wall on its upper surface.

10. The storage system of claim 6 wherein the overall width of each of said shelves is from ½ to 1 inch greater than said top diameter of said pails.

* * * * *